US012111071B2

(12) United States Patent
Heo et al.

(10) Patent No.: US 12,111,071 B2
(45) Date of Patent: Oct. 8, 2024

(54) MULTIFUNCTIONAL STORAGE SYSTEM HAVING SEPARATE CLEANING FLOW PASSAGE

(71) Applicant: COWAY CO., LTD., Gongju-si (KR)

(72) Inventors: Sung Hwan Heo, Seoul (KR); Jin Min Kim, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 608 days.

(21) Appl. No.: 17/418,573

(22) PCT Filed: Dec. 11, 2019

(86) PCT No.: PCT/KR2019/017438

§ 371 (c)(1),
(2) Date: Apr. 11, 2022

(87) PCT Pub. No.: WO2020/138768

PCT Pub. Date: Jul. 2, 2020

(65) Prior Publication Data

US 2022/0243931 A1 Aug. 4, 2022

(30) Foreign Application Priority Data

Dec. 27, 2018 (KR) ..... 10-2018-0171185

(51) Int. Cl.
*F25D 17/06* (2006.01)
*F24F 3/14* (2006.01)
(Continued)

(52) U.S. Cl.
CPC ..... *F24F 3/14* (2013.01); *F24F 7/007* (2013.01); *F24F 8/10* (2021.01); *F24F 2003/144* (2013.01)

(58) Field of Classification Search
CPC ..... F24F 3/14; F24F 8/10; F24F 7/007; F24F 2003/144
(Continued)

(56) References Cited

U.S. PATENT DOCUMENTS 8,539,694 B2 9/2013 Moon et al.
10,316,461 B2 6/2019 Bae et al.
(Continued)

FOREIGN PATENT DOCUMENTS

CN 204534969 U * 8/2015
CN 108569734 A * 9/2018
(Continued)

OTHER PUBLICATIONS

International Search Report issued on Apr. 3, 2020 in PCT/KR2019/017438 filed on Dec. 11, 2019, 2 pages.
(Continued)

*Primary Examiner* — Davis D Hwu
(74) *Attorney, Agent, or Firm* — Oblon, McClelland, Maier & Neustadt, L.L.P.

(57) ABSTRACT

A multifunctional storage system includes a storage chamber and a machine chamber provided on one side of the storage chamber and in fluid communication with the storage chamber. The system also includes a humidifier configured to generate naturally humidified air with a circulation filter unit; a dehumidifier configured to generate dried air with a heat pump module; a cleaning filter unit configured to purify exterior air; a first flow passage in which the humidifier band the dehumidifier are embedded and configured such that the naturally humidified or dried air flows therethrough; a second flow passage configured such that the exterior air filtered by the cleaning filter unit flows therethrough; and a fan unit configured to circulate air in one direction. The first and second flow passages form flow passages that are independently formed and separated from each other, and formed to be in communication with the fan unit.

9 Claims, 6 Drawing Sheets

(51) Int. Cl.
*F24F 7/007* (2006.01)
*F24F 8/10* (2021.01)

(58) Field of Classification Search
USPC ..... 62/419
See application file for complete search history.

(56) References Cited

U.S. PATENT DOCUMENTS

| | | | |
|---|---|---|---|
| 2009/0151188 | A1 | 6/2009 | Moon et al. |
| 2010/0018072 | A1 | 1/2010 | Kim et al. |

FOREIGN PATENT DOCUMENTS

| | | | |
|---|---|---|---|
| JP | 2012-313 | A | 1/2012 |
| KR | 10-0672490 | B1 | 1/2007 |
| KR | 10-0672491 | B1 | 1/2007 |
| KR | 10-2008-0004028 | A | 1/2008 |
| KR | 10-2008-0105499 | A | 12/2008 |
| KR | 20-2009-0000055 | U | 1/2009 |
| KR | 10-2009-0013950 | A | 2/2009 |
| KR | 10-2010-0121201 | A | 11/2010 |
| KR | 10-2015-0010584 | A | 1/2015 |

OTHER PUBLICATIONS

Office Action issued Nov. 30, 2021 in corresponding Korean Patent Application No. 10-2018-0171185, 4 pages.

* cited by examiner

MULTIFUNCTIONAL STORAGE SYSTEM HAVING SEPARATE CLEANING FLOW PASSAGE

BACKGROUND OF THE INVENTION

1. Field of the Invention

The present disclosure relates to a multifunctional storage system having a separate flow passage, and more particularly to a multifunctional storage system that separately has one integrated dehumidification/humidification flow passage and a cleaning flow passage to increase an efficiency of cleaning clothing and increase an efficiency of cleaning air of a space in which the multifunctional storage system is installed.

2. Description of the Prior Art

Steam is used in a closet, a storage closet, or a clothing manager that is a cabinet that receives clothing, a blanket, and various daily necessities therein to remove contaminants or malodorous substances, such as dust, which are stuck to the articles and to improve wrinkles.

When steam is directly ejected to an article such as clothing in the interior of the cabinet, water molecules of the steam evaporate together while containing contaminants or malodorous materials, and thus the contaminants or the malodorous materials are removed, and wrinkles are improved.

Here, the "steam" is water of a high temperature of about 100 degrees Celsius, which is ejected in the form of gas through a high-pressure nozzle, and visually appears similar to misty smoke when being ejected at room temperature.

However, it has been reported that clothing may be damaged when steam is used. For example, when steam of a high temperature or steam of a high temperature and a high pressure is directly ejected to clothing of a sensitive material, the corresponding material may be damaged. As another example, when water molecules generated from steam condense after being ejected at room temperature, they become water droplets, and the water droplets are left in the clothing unless dehumidification is effectively performed, and when such state continues for a long time, the clothing of a sensitive material is also damaged.

Furthermore, when steam is directly ejected to a plastic part included in clothing, environmental hormones that are very harmful to human bodies may be generated, which is a critical problem.

Meanwhile, in recent years, as atmospheric pollutants, for example, due to fine dust, have become severe, devices, such as an air cleaner, which are related to purification of air have received much attention. Accordingly, in recent years, the need has increased for technologies for cleaning clothing received in a storage chamber and purifying exterior air at the same time, and in particular, development of an internal structure for a clothing manager that may increase both an efficiency of clothing management and an efficiency of air cleaning has also become increasingly necessary.

(Patent document 1) Korean Patent No. 10-0672490

(Patent document 2) Korean Patent No. 10-0672491

SUMMARY OF THE INVENTION

The present disclosure has been made in an effort to solve the above-described problems.

A multifunctional storage system according to the present disclosure provides a multifunctional storage system that performs cleaning, humidification, drying, and dehumidification, which have been problems of the conventional technology, through only one flow passage, and prevents loss of performance thereof as it inevitably passes through not only a filter but a heat exchanger and a humidification filter and passes through components that are not used in operations of modes.

In accordance with an aspect of the present disclosure, there is provided a multifunctional storage system including a storage chamber 100 and a machine chamber 200 provided on one side of the storage chamber 100 and in fluid communication with the storage chamber 100, the multifunctional storage system including: a humidifier including a circulation filter unit 212 and configured to generate naturally humidified air with the circulation filter unit 212; a dehumidifier 220 including a heat pump module and configured to generate dried air with the heat pump module; a cleaning filter unit 230 configured to purify exterior air; a first flow passage 240, in which the humidifier band the dehumidifier 220 are embedded, and configured such that the naturally humidified air or the dried air flows therethrough; a second flow passage 250 configured such that the exterior air filtered by the cleaning filter unit 230 flows therethrough; and a fan unit 260 configured to circulate air, wherein the first and second flow passages 240 and 250 form flow passages that are independent and separated from each other, and are formed to be in communication with the fan unit 260.

The humidifier, the dehumidifier 220, the cleaning filter unit 230, the first flow passage 240, the second flow passage 250, and the fan unit may be provided in the machine chamber 200, and the fan unit 260 may be a blowing fan disposed on a front side of the machine chamber 200 and may be in fluid communication with front ends of the first and second flow passages 240 and 250, and provided with a passage-switching member 264 to adjust fluid communication with the first and second flow passages 240 and 250.

The machine chamber 200 may be provided with an intake hole 270 and an exhaust hole 272 that communicate the exterior air with the machine chamber 200, one side of the fan unit 260 may be in communication with the intake hole 270, an opposite side of the fan unit 260 may be in communication with the second flow passage 250, and the cleaning filter unit 230 may be provided on a side that is close to the intake hole 270, and in an air cleaning mode of filtering the exterior air, the exterior air introduced from the intake hole 270 may be filtered by the fan unit 260 while passing through the cleaning filter unit 230, may flow through the second flow passage 250, and may be discharged through the exhaust hole 272.

The storage chamber 100 may include a circulation air inlet 110 and a circulation air outlet 112 that communicate the storage chamber 100 with the machine chamber 200, the circulation air inlet 110 may be in communication with a rear end of the first flow passage 240, and the circulation air outlet 112 may be in communication with one side of the fan unit 260, and in a clothing managing mode of alternately operating the humidifier and the dehumidifier 220, the naturally humidified air or the dried air may be made to flow in a sequence of the first flow passage 240, the circulation air inlet 110, the storage chamber 100, and the circulation air outlet 112 by the fan unit 260 and may be introduced into the fan unit 260 again to circulate.

The multifunctional storage system may further include a door 600 covering front sides of the machine chamber 200 and the storage chamber, excluding the intake hole 270, the door 600 including: a controller 610, and an exhaust door 650 configured to open and close the exhaust hole 272; and the exhaust door 650 may be opened in the air cleaning mode, and may be closed in the clothing managing mode.

In the clothing managing mode, hot air may be generated by the heat pump module of the dehumidifier 220, and the dried air, which is hot air, is discharged into the storage chamber 100.

The machine chamber 200 may be provided with: a supply vessel 280, and a condensation vessel 282; the circulation filter unit 212 located in the first flow passage 240 may be supplied with moisture from the supply vessel 280 provided on an outer side of the first flow passage 240; and condensed water generated from the circulating air in the storage chamber 110 and the first flow passage 240 may be stored in the condensation vessel 282.

A first flow passage communication hole 261 and a second flow passage communication hole 262 may be formed in the fan unit 260, and the passage-switching member 264 may be configured to be slid along an inner surface of a casing of the fan unit 260, the fan unit 260 and the second flow passage 250 may be in communication with each other when the passage-switching member 264 is slid to a first location, at which the first flow passage communication hole 261 is closed, and the fan unit 260 and the first flow passage 240 may be in communication with each other when the passage-switching member 264 is slid to a second location, at which the second flow passage communication hole 262 is closed.

The passage-switching member 264 may be slid to a third location, at which both the first and second passage communication holes 261 and 262 are opened, and the fan unit 260 may be in communication with both the first and second flow passages 240 and 250 at the third location to perform the clothing managing mode and the air cleaning mode at the same time.

In the multifunctional storage system according to the present disclosure, air may flow according to the functions of the modes by separating the passage through which naturally humidified air or dried air passes in the clothing managing mode and the passage through which cleaned air flows in the air cleaning mode, and thereby the humidification/dehumidification efficiency may be maximized, and the cleaning efficiency may also be maximized.

Furthermore, because the humidifier and the dehumidifier are disposed together in one closed passage, a condensation load may be improved by using latent heat of the dehumidifier, and thereby the humidification/dehumidification may be improved.

DETAILED DESCRIPTION OF THE EXEMPLARY EMBODIMENTS

Figure 1:
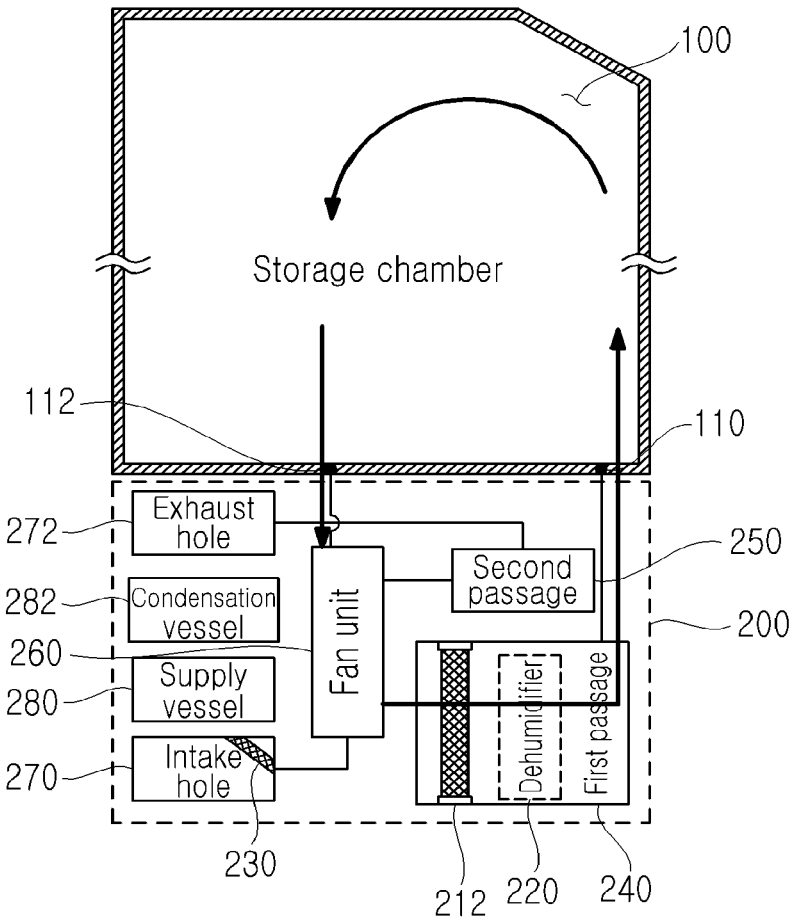
FIG. 1 is a conceptual view illustrating a clothing managing mode of a multifunctional storage system according to the present disclosure.

Hereinafter, a multifunctional storage system according to the present disclosure will be described with reference to the drawings.

For a description of the present disclosure, terms such as a front side (the X axis), a rear side (the −X axis), a right side (the Y axis), a left side (the −Y axis), an upper side (the Z axis), and a lower side (the −Z axis) are used, and a coordinate system is illustrated in the drawings, but this is only for a description of the present disclosure, and the present disclosure is not limited by the corresponding directions.

Description of Structure of Multifunctional Storage System

A multifunctional storage system according to the present disclosure will be described with reference to FIGS. 1 and 2.

The multifunctional storage system according to the present disclosure includes a storage chamber 100, a machine chamber 200, and a door 600, which will be described below.

The storage chamber 100 is a space in which clothing and the like are received such that contaminants and malodorous substances are removed from the clothing and the like. To achieve this, the temperature of an interior of the storage chamber 100 may be increased to a high temperature, and naturally humidified air may be introduced into the storage chamber 100 to circulate as circulation air. Details thereof will be described in relation to operation modes.

When the storage chamber 100 is viewed from the inside, a circulation air inlet 110 and a circulation air outlet 112 are located on a lower surface of the storage chamber 100, and a functional material storage part (not illustrated) may be additionally provided. The circulation air inlet 110 and the circulation air outlet 112 are openings through which the circulation air inside the storage chamber 100 is introduced and discharged to and from the machine chamber 200.

The circulation air inlet 110 is in communication with the fan unit 260 such that air is discharged from the machine chamber 200 toward the storage chamber 100, and the circulation air outlet 112 is configured such that the air circulates from the storage chamber 100 toward the machine chamber 200.

Figure 2:
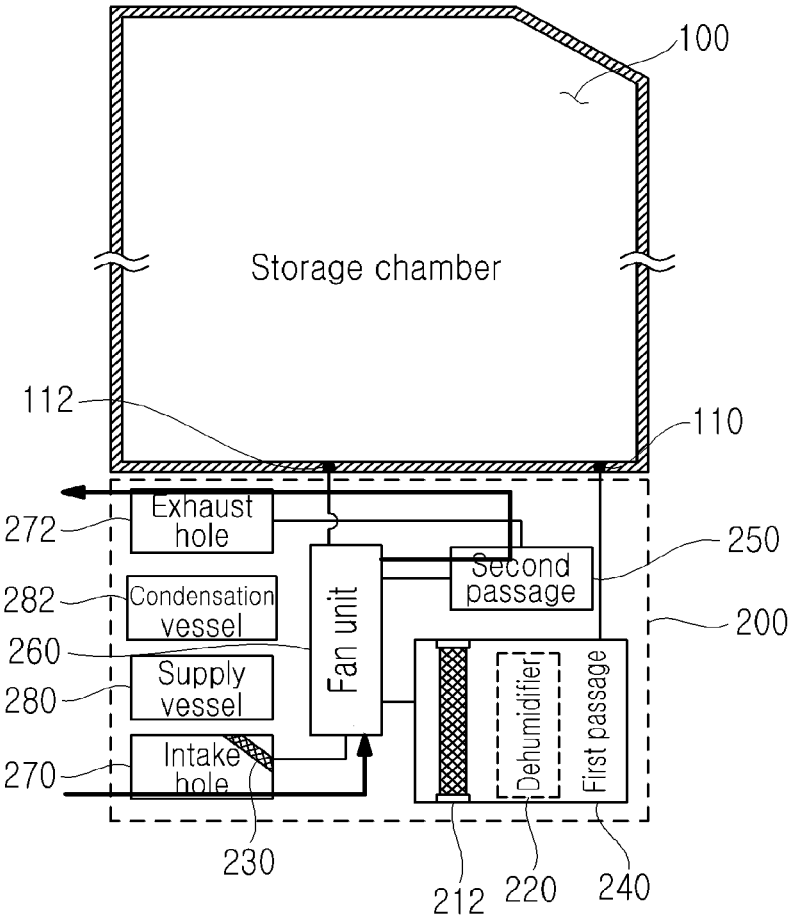
FIG. 2 is a conceptual view illustrating an air cleaning mode of the multifunctional storage system according to the present disclosure.

In FIGS. 1 and 2, the circulation air inlet 110 is located on the rear side, and the circulation air outlet 112 is located on the front side, but this may be changed according to selection of a designer.

The functional material storage part (not illustrated) is a space in which materials for adding functions, except for removal of contaminants or malodorous substances of articles, such as clothing and the like received in the interior of the storage chamber 100, and for example, odor-emitting materials may be received in the functional material storage part to be discharged to the storage chamber 100. Furthermore, the functional materials may be made to be periodically filled by a user.

The machine chamber 200 is a space for performing an air cleaning mode, and is a space that functions to circulate air by introducing the air from the storage chamber 100, filtering the air, and discharging naturally humidified air as circulation air in a clothing managing mode.

The machine chamber 200 may be located in any direction with respect to the storage chamber 100, but it is preferable that the machine chamber 200 is located below the storage chamber 100. This is because the condensed air or saturated humid air condensed in the storage chamber 100 may be introduced into the machine chamber 200 by its own weight to be discharged through a condensation vessel 282.

In detail, all of a humidifier, a dehumidifier 220, a cleaning filter unit 230, a first flow passage 240, a second flow passage 250, and a fan unit 260 are located in the machine chamber 200.

The humidifier includes a circulation filter unit 212, and generates the naturally humidified air with the circulation filter unit 212. Here, the humidifier is a concept including all other components used to humidify the storage chamber as well as the circulation filter unit 212, and for example, includes all of tubes that connect a supply vessel 280 and the circulation filter unit 212. The circulation filter unit 212 may function to filter the circulation air. The circulation filter unit 212 may include a humidifying filter, and when water stored in the supply vessel 280 is supplied to the humidifying filter, moisture is supplied to form the naturally humidified air in a process of the circulation air passing through the humidifying filter. Furthermore, a user may open the door 600 and access a circulation filter mounting part (not illustrated) to demount or mount the circulation filter unit 212, and in particular, only the humidifying filter may be periodically separated and replaced.

The dehumidifier 220 includes a heat pump module, and generates dried air with the heat pump module. That is, the dehumidifier 220 performs a function of dehumidifying the circulation air that flows in the storage chamber 100. Through the dehumidification, the air in the interior of the storage chamber 100 and the circulation air may be cleanly maintained, and recontamination may be prevented. The circulation air in the storage chamber 100 may be dehumidified, or the circulation air that flows from the storage chamber 100 to the machine chamber 200 may be dehumidified.

FIGS. 1 and 2 illustrate that the circulation filter unit 212 is located on the front side of the dehumidifier 220, but it is apparent that the circulation filter unit 212 may be located on the rear side of the dehumidifier 220 according to selection of a designer, and may be variously changed according to an internal structure of the first flow passage 240.

Meanwhile, heat may be generated in a process of performing dehumidification by way of the dehumidifier 220, and the heat may not be discarded, but may be used in the clothing managing mode. Accordingly, hot air may be generated by the heat pump module in the clothing managing mode, and dry hot air may be supplied into the storage chamber 100. For example, after the storage chamber 100 is heated to about 50 to 70 degrees Celsius by using heat generated in a process of performing dehumidification by the dehumidifier 220, the circulation air of a room temperature may be received from the first flow passage 240 through the circulation air inlet 110, and thereby contaminants or malodorous substances of clothing and the like may be removed.

As another example, as described above, the heat generated in the process of performing dehumidification by way of the dehumidifier 220 may be supplied to the humidifying filter of the circulation filter unit 212 or be provided to the tube that connects the supply vessel 280 and the humidifying filter to heat the naturally humidified air that functions as circulation air. The above-described temperature is exemplary, and the present disclosure is not to be limited thereto, and may be variously modified. Furthermore, only one of the dehumidifier 220 and the circulation filter unit 212 (particularly the humidifying filter) may be operated so that they do not interfere with each other.

An intake hole 270 is a part that suctions exterior air into the interior of the machine chamber 200. It may be opened or closed according to selection. For example, it is opened in the air cleaning mode, and may be closed in the clothing managing mode. It is preferable that the location of the intake hole 270 is below an exhaust hole 272, which will be described below, and it is more preferable that it is located at a lowermost end of the machine chamber 200. Because the intake hole 270 is closed in the clothing managing mode, the circulation flow passage for the circulation air may become simpler, and it is not preferable that the door 600 does not reach the intake hole 270.

The intake hole 270 may be located in a cleaning filter unit mounting part (not illustrated), and the cleaning filter unit 230 may be located in the cleaning filter unit mounting part. The cleaning filter unit 230 may function to filter exterior air suctioned in the air cleaning mode, and may include a free filter and a HEPA filter, but the present disclosure is not limited thereto.

The flow passage 240 is a flow passage through which the naturally humidified air or the dried air flows, and is closed while both of the humidifier and the dehumidifier 220 are embedded. A front end of the first flow passage 240 is in communication with the fan unit 260, and a rear end of the first flow passage 240 is in communication with the circulation air inlet 110 in the storage chamber 100.

The first flow passage 240 functions as a passage through which the naturally humidified air or the dried air flows, and provides a space in which the humidifier or the dehumidifier 220 is mounted, and may interrupt physical communication of the machine chamber 200 with the other components. Accordingly, loss of heat and moisture due to friction with the other components of the machine chamber 200 may be minimized while the naturally humidified air or the dried air flows, and this shows an effect of maximizing the humidification efficiency and the dehumidification efficiency. Furthermore, as the residing time of the heat generated by the dehumidifier 220 becomes longer, the condensation load in the first flow passage 240 may increase.

The circulation filter unit 212 and the dehumidifier 220 may be sequentially disposed in the first passage 240 with respect to the flow direction of the air, but the disposition sequence may be changed according to selection by a designer.

The second flow passage 250 is a flow passage through which the filtered exterior air flows, and is separated from the other components in the machine chamber 200 as well as the first flow passage 240. In more detail, the front end of the second flow passage 250 is in communication with the fan unit 260, and the opposite end thereof is in communication with the exhaust hole 272 so that the filtered exterior air may be discharged to the outside again after being purified.

The fan unit 260 circulates air in one direction, and in more detail, includes a blowing fan disposed on the front side of the machine chamber 200, and functions to compulsorily push air to the first flow passage 240 and the second flow passage 250. Then, the fan unit 260 is in individual communication with a total of four components, and is in communication with the intake hole 270, the front end of the first flow passage 240, the front end of the second flow passage 250, and the circulation air outlet 112.

A passage-switching member 264 is provided in the interior of the fan unit 260, and thus the fluid communication of the fan unit 260 with the first and second flow passages 240 and 250 may be adjusted, and thereby the flow passage of the air discharged from the fan unit 260 may be changed.

Meanwhile, the supply vessel 280 and the condensation vessel 282 are located on the front side of the machine chamber 200, and thus the approach performance of the user may be maximized, the user may easily fill the water in the supply vessel 280, and the water reserved in the condensation vessel 282 may be discarded. Here, both of the supply vessel 280 and the condensation vessel 282 are provided outside of the first and second flow passages 240 and 250.

Description of Operation Mode of Multifunctional Storage System

An operation mode of the multifunctional storage system according to the present disclosure will be described with reference to FIGS. 1 and 2.

First, a "clothing managing mode" will be described. This means a flow passage of the air illustrated in FIG. 1.

The clothing managing mode is a mode for removing contaminants or malodorous substances from clothing and the like located inside the storage chamber 100. The naturally humidified air is circulated as circulation air so that the interior of the storage chamber 100 becomes a humid environment, and the contaminants or the malodorous substances are removed together with the humid air, and they are introduced and discharged as condensed water. That is, the dehumidifier 220 performs a function of dehumidifying the circulation air that flows in the storage chamber 100. Optionally, the interior of the storage chamber 100 may be heated by using the heat generated by the dehumidifier 220.

When the user selects the clothing managing mode, the exhaust door 650 of the door 600 is closed, and the intake hole 270 is also closed. That is, in the clothing managing mode, the air in the storage chamber 100 is substantially not discharged to the outside.

That is, the dehumidifier 220 dehumidifies the circulation air that flows in the storage chamber 100. Optionally, the heat generated in the process may heat the interior of the storage chamber 100, and the temperature of the heat may be 50 to 70 degrees Celsius, but the present disclosure is not limited thereto. The water in the supply vessel 280 is supplied to the humidifying filter such that the humidifying filter provided in the circulation filter unit may contain moisture. In the process, the humidifying filter or the water supplied to the humidifying filter may be heated by the dehumidifier 220 or the heat generated by a separate heating member (not illustrated).

Then, the operation of the humidifier and the operation of the dehumidifier are performed for predetermined periods of time, and are performed alternately, and thus the humidification and the dehumidification are performed repeatedly. While the process is repeated, the circulation air continuously circulates between the storage chamber 100 and the machine chamber 200. The circulation air contains the contaminants or the malodorous substances in the storage chamber 100, and provides the user with a comfortable environment because they are not discharged to the outside. At the same time, when the circulation air containing the contaminants or the malodorous substances is first introduced into the machine chamber 200, it is filtered by the circulation filter unit 212, condensed as the condensed water, and separately collected in the condensation vessel 282, such that this is preferable because a recontamination phenomenon, in which the contaminants or the malodorous substances are supplied to the storage chamber 100, does not occur again.

Next, the "air cleaning mode" will be described. FIG. 2 will be referenced.

The air cleaning mode is a mode for performing a function of cleaning exterior air by operating only the machine chamber 200 independently from the storage chamber 100. That is, it is an operation mode in which exterior air is not introduced into the storage chamber 100 because clean clothing may be located in the interior of the storage chamber in a state in which the exterior air is contaminated.

When the user selects the clothing cleaning mode, the exhaust door 650 of the door 600 is opened, and the intake hole 270 is also opened.

If the fan unit 260 is operated, the exterior air naturally introduced from the intake hole is filtered while passing through the cleaning filter unit 230. Here, the multifunctional storage system according to the present disclosure is a blowing fan, and uses a principle of the exterior air located in the intake hole 270 naturally flowing toward the fan unit 260 due to a pressure difference due to operation of the fan unit 260 if the fan unit 260 is operated.

In more detail, in the air cleaning mode, the exterior air introduced from the intake hole 270 is discharged through the exhaust hole 272 via the cleaning filter unit 230, the fan unit 260, and the second flow passage 250, and may purify the air in the space in which the multifunctional storage system according to the present disclosure is located.

Figure 6:
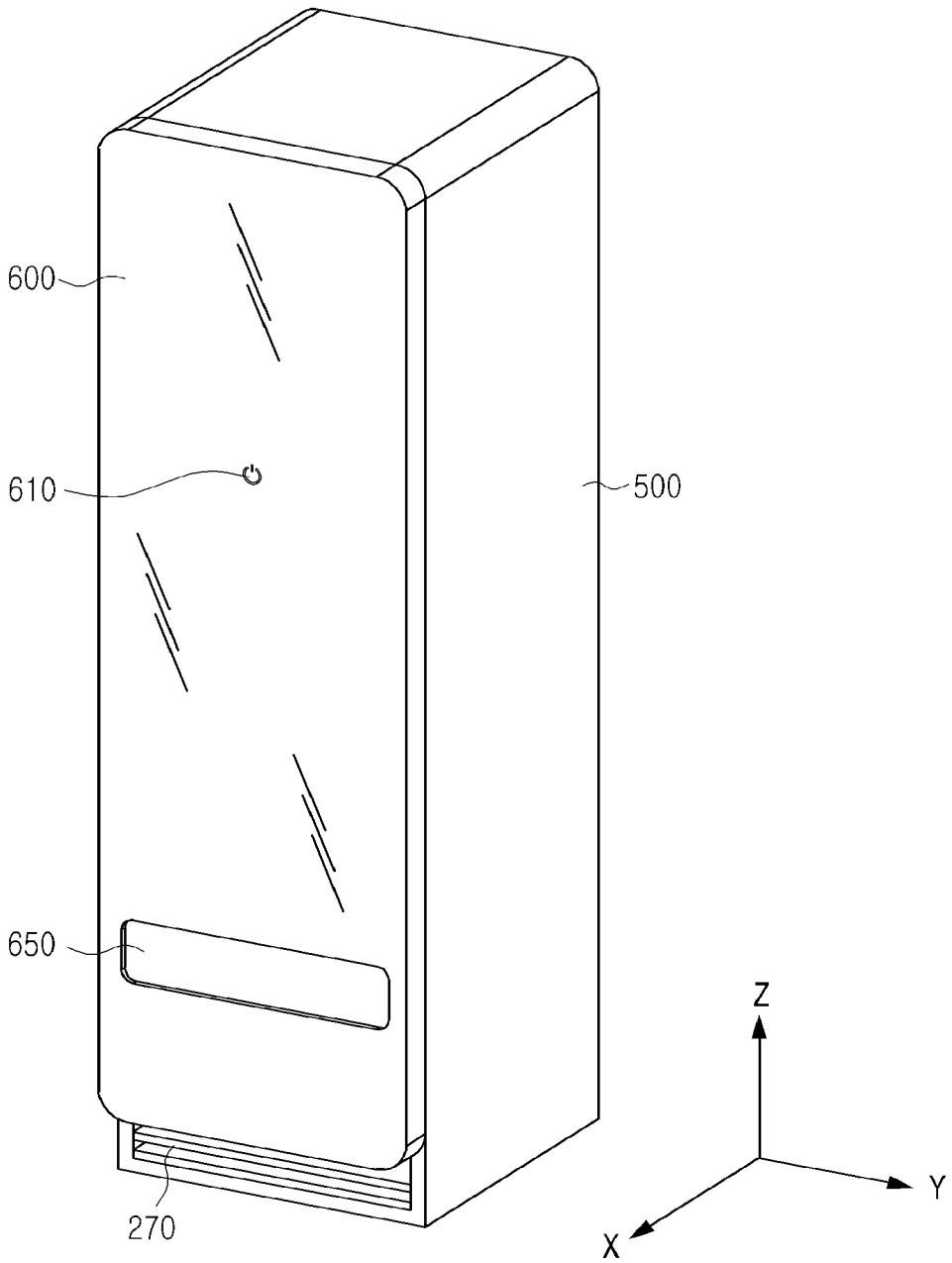
FIG. 6 is a perspective view illustrating the multifunctional storage system according to the present disclosure.

Referring to FIG. 6, the intake hole 270 is not closed by the door 600, and this is preferable because the air cleaning mode may be performed regardless of the opening state of the door 600 by the user. Even when the air operation mode is operated, the user may freely open the door 600 to place or withdraw clothing into or from the storage chamber 100. At any time, the water may be filled in the supply vessel 280, and may be discharged from the condensation vessel 282. The door 600 does not cover the intake hole 210, and the exhaust hole 270 is opened from an inside of the door 600, and thus the opening of the door 600 does not influence the air cleaning mode.

Description of Flow Passage Changing Structure of Fan Unit

Figure 4:
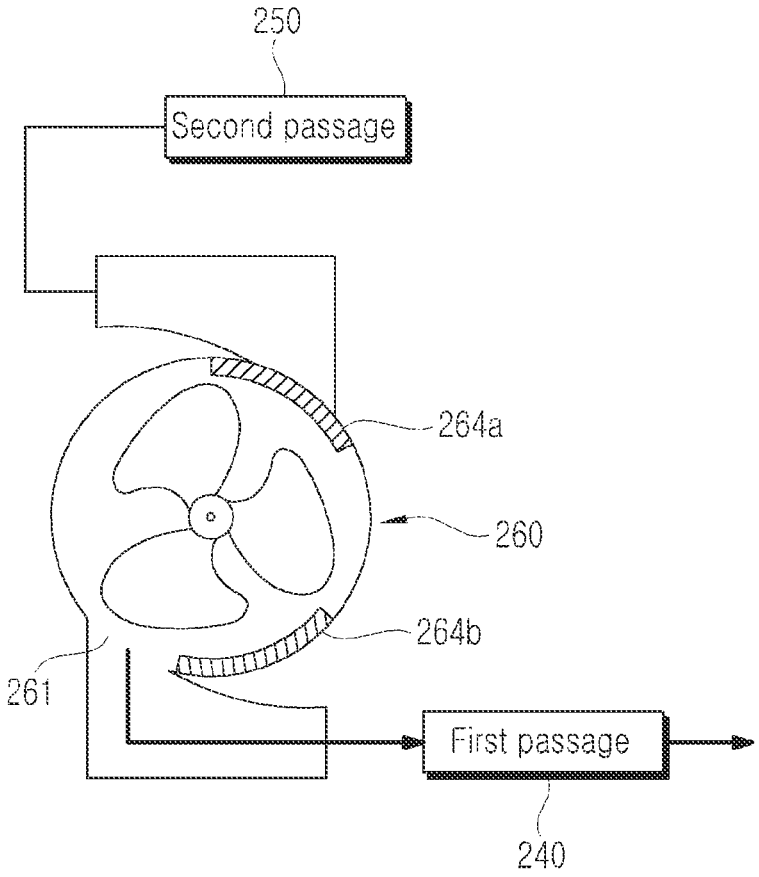
FIG. 4 is a conceptual view schematically illustrating a state in which the fan unit and the first and second flow passages of the multifunctional storage system according to the present disclosure are in communication with one another, and illustrates a flow direction of the air when the passage-switching member is at a second location.
Figure 5:
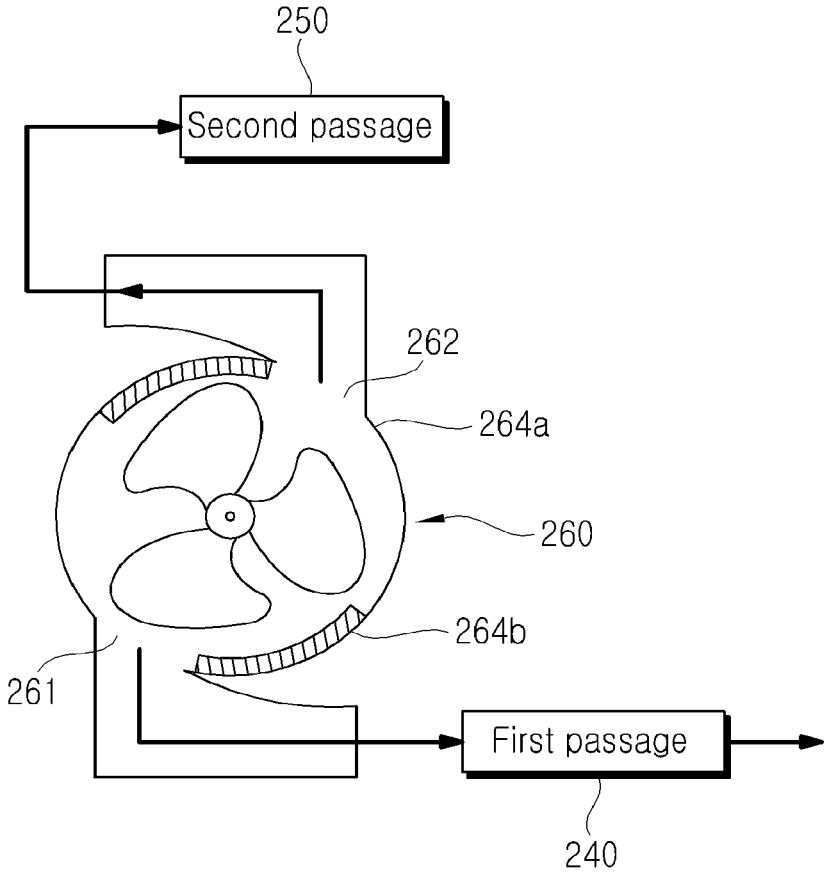
FIG. 5 is a conceptual view schematically illustrating a state in which the fan unit and the first and second flow passages of the multifunctional storage system according to the present disclosure are in communication with one another, and illustrates a flow direction of the air when the passage-switching member is at a third location.

Hereinafter, the flow passage changing structure of the fan unit 260 will be described with reference to FIGS. 3 to 5. As described above, the fan unit 260 is in individual communication with a total of four components, and is in communication with the intake hole 270, the front end of the first flow passage 240, the front end of the second flow passage 250, and the circulation air outlet 112, but the communication structure with the intake hole 270 and the circulation air outlet 112 is omitted in FIGS. 3 to 5.

Figure 3:
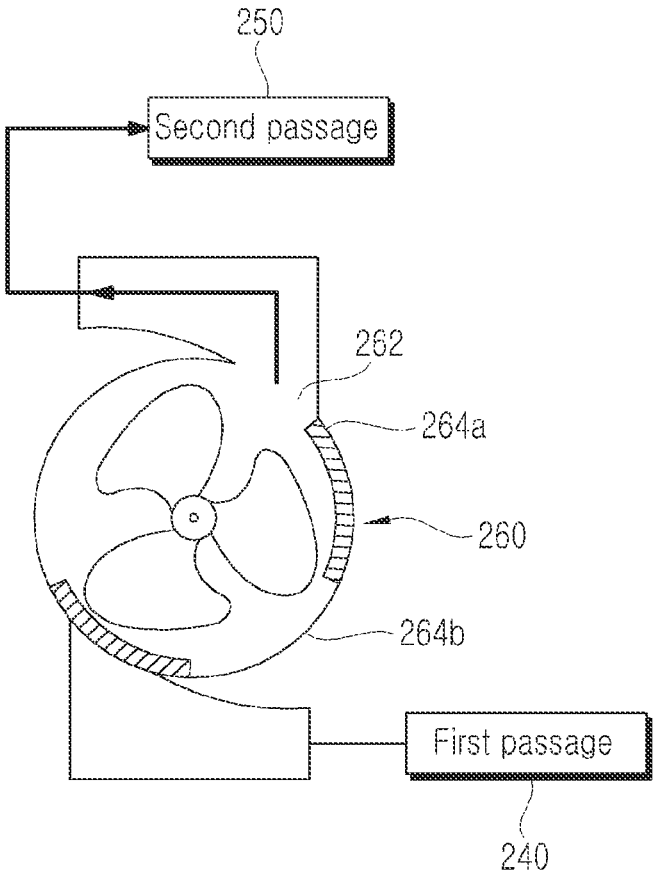
FIG. 3 is a conceptual view schematically illustrating a state in which a fan unit and first and second flow passages of the multifunctional storage system according to the present disclosure are in communication with one another, and illustrates a flow direction of air when a passage-switching member is at a first location.

FIG. 3 is a conceptual view schematically illustrating a state in which a fan unit and first and second flow passages of the multifunctional storage system according to the present disclosure are in communication with one another, and illustrates a flow direction of air when a passage-switching member is at a first location. FIG. 4 is a conceptual view schematically illustrating a state in which the fan unit and the first and second flow passages of the multifunctional storage system according to the present disclosure are in communication with one another, and illustrates a flow direction of the air when the passage-switching member is at a second location.

The fan unit 260 has a first flow passage communication hole 261 and a second flow passage communication hole 262, the passage-switching member 264 is formed to be slid along an inner surface of the casing of the fan unit 260, and the fan unit 260 and the second flow passage 250 are in communication with each other when the passage-switching member 264 is slid to a "first location" for closing the first flow passage communication hole 261.

In contrast, the fan unit 260 and the first flow passage 240 are in communication with each other when the passage-switching member 264 is slid to a second location for closing the second flow passage communication hole 262.

That is, the first location corresponds to the air cleaning mode, and the second location corresponds to the clothing managing mode. Here, the passage-switching member 264 may include a first passage-switching member 264*a* and a second passage-switching member 264*b*, and it is preferable that they are paired to be operated. Of course, as described above, it is preferable that the communication of the fan unit 260 with the intake hole 270 is interrupted at the first location, and it is preferable that the fan unit 260 with the circulation air outlet 112 is interrupted at the second location.

Meanwhile, the user may want both the purification of the exterior air and the management of the clothing, and thus the multifunctional storage system according to the present disclosure may perform the clothing managing mode and the air cleaning mode at the same time. This is because the first and second flow passages 240 and 250 form the flow passages that are independently closed and separated from each other, and the air flowing through the first flow passage 240 and the second flow passage 250, respectively, are prevented from being mixed.

Here, the passage-switching member 264 may be slid to a "third location", at which both of the first and second flow passage communication holes 261 and 262 may be opened, and at the third location, the fan unit 260 is in communication with both of the first and second flow passages 240 and 250, and thereby the clothing managing mode and the air cleaning mode may be performed at the same time.

Although the embodiments illustrated in the drawings have been described in the specification for reference such that a person skilled in the art can easily understand and realize the present disclosure, they are merely exemplary, and a person skilled in the art can understand that various modifications and equivalent embodiments are also made from the embodiments of the present disclosure. Accordingly, the scope of the present disclosure should be determined by the claims.

What is claimed is:

1. A multifunctional storage system including a storage chamber and a machine chamber provided on one side of the storage chamber and in fluid communication with the storage chamber, the multifunctional storage system comprising:

a humidifier including a circulation filter unit and configured to generate naturally humidified air with the circulation filter unit;

a dehumidifier including a heat pump module and configured to generate dried air with the heat pump module;

a cleaning filter unit configured to purify exterior air;

a first flow passage, in which the humidifier and the dehumidifier are embedded, configured such that the naturally humidified air or the dried air flows therethrough;

a second flow passage configured such that the exterior air filtered by the cleaning filter unit flows therethrough; and a fan unit configured to circulate air, wherein the first flow passage and the second flow passage form flow passages that are independently formed and separated from each other, and are formed to be in communication with the fan unit, wherein the fan unit is in fluid communication with front ends of the first and second flow passages and provided with a passage-switching member to adjust fluid communication with the first and second flow passages, wherein the machine chamber is provided with an intake hole and an exhaust hole that communicate the exterior air with the machine chamber, wherein one side of the fan unit is in communication with the intake hole, an opposite side of the fan unit is in communication with the second flow passage, and the cleaning filter unit is provided on a side that is close to the intake hole, wherein the storage chamber comprises a circulation air inlet and a circulation air outlet that communicate the storage chamber with the machine chamber, and wherein the circulation air inlet is in communication with a rear end of the first flow passage, and the circulation air outlet is in communication with one side of the fan unit.

2. The multifunctional storage system of claim 1, wherein the humidifier, the dehumidifier, the cleaning filter unit, the first flow passage, the second flow passage, and the fan unit are provided in the machine chamber, and wherein the fan unit is a blowing fan disposed on a front side of the machine chamber.

3. The multifunctional storage system of claim 2, wherein, in an air cleaning mode of filtering the exterior air, the exterior air introduced from the intake hole is filtered by the fan unit while passing through the cleaning filter unit, flows through the second flow passage, and is discharged through the exhaust hole.

4. The multifunctional storage system of claim 3, further comprising:

a door covering front sides of the machine chamber and the storage chamber, excluding the intake hole, wherein the door comprises:

a controller; and an exhaust door configured to open and close the exhaust hole, and wherein the exhaust door is opened in the air cleaning mode, and is closed in a clothing managing mode.

5. The multifunctional storage system of claim 2, wherein, in a clothing managing mode of alternately operating the humidifier and the dehumidifier, the naturally humidified air or the dried air is made to flow in a sequence of the first flow passage, the circulation air inlet, the storage chamber, and the circulation air outlet by the fan unit and is introduced into the fan unit again to circulate.

6. The multifunctional storage system of claim 5, wherein, in the clothing managing mode, hot air is generated by the heat pump module of the dehumidifier, and the dried air, which is hot air, is discharged into the storage chamber.

7. The multifunctional storage system of claim 2, wherein the machine chamber is provided with:

a supply vessel; and a condensation vessel, wherein the circulation filter unit located in the first flow passage is supplied with moisture from the supply vessel provided on an outer side of the first flow passage, and wherein condensed water generated from the circulating air in the storage chamber and the first flow passage is stored in the condensation vessel.

8. The multifunctional storage system of claim 2, wherein a first flow passage communication hole and a second flow passage communication hole are formed in the fan unit, and the passage-switching member is configured to be slid along an inner surface of a casing of the fan unit, wherein the fan unit and the second flow passage are in communication with each other when the passage-switching member is slid to a first location, at which the first flow passage communication hole is closed, and wherein the fan unit and the first flow passage are in communication with each other when the passage-switching member is slid to a second location, at which the second flow passage communication hole is closed.

9. The multifunctional storage system of claim 8, wherein the passage-switching member is slid to a third location, at which both the first and second passage communication holes are open, and wherein the fan unit is in communication with both the first and second flow passages at the third location to perform a clothing managing mode and an air cleaning mode at the same time.

* * * * *